United States Patent [19]

Oliver

[11] 4,188,749

[45] Feb. 19, 1980

[54] TOY WHEEL AND DRIVING ROD

[76] Inventor: Louise I. Oliver, 538 W. 79th St., Los Angeles, Calif. 90044

[21] Appl. No.: 972,702

[22] Filed: Dec. 26, 1978

[51] Int. Cl.[2] ..... A63H 33/02

[52] U.S. Cl. ..... 46/220; 46/221

[58] Field of Search ..... 46/220, 114, 221; 273/126 R

[56] References Cited

U.S. PATENT DOCUMENTS

| | | | |
|---|---|---|---|
| 418,885 | 1/1890 | Branagan et al. | 46/220 |
| 3,001,324 | 9/1961 | Walker | 46/220 |
| 3,408,770 | 11/1968 | Smolinski et al. | 46/221 |

*Primary Examiner*—Russell R. Kinsey
*Assistant Examiner*—Mickey Yu
*Attorney, Agent, or Firm*—Ralph B. Pastoriza

[57] ABSTRACT

The toy wheel is made up of two flat discs having central openings and sandwiching a ring of foam-like material therebetween. A metal rim in turn surrounds the foam like material so that when the assembled wheel is rolled along a pavement, noise is generated by the metal rim. A driving rod includes a handle and stem portion terminating in a hook arranged to straddle the outer peripheral edges of the assembled wheel so that the wheel can be nudged along by the rod in rolling engagement with the ground. Psychedelic designs may be provided on the outer exposed faces of the wheel discs to provide a visual effect in addition to noise generated by the metal rim. Also, the relatively large central opening permits the use of the hook portion of the rod to engage within the central opening to capture the wheel should it get out of control.

4 Claims, 3 Drawing Figures

TOY WHEEL AND DRIVING ROD

This invention relates generally to toys and more particularly to an improved toy wheel and driving rod.

BACKGROUND OF THE INVENTION

Wheels for rolling along the ground or pavement by driving rod have been known for a number of years and provide substantial amusement for children. Generally, the wheels themselves simply constitute a metal rim or ring and the rod a simple elongated piece of wood which can periodically be caused to engage the outer periphery of the wheel to nudge it along in rolling engagement.

Various improved wheel and rod structures have been developed throughout the years. For example, the driving rod itself may be provided with a forked end to straddle the outer rim of the wheel to provide greater control by a user in nudging the wheel in a given direction. Also, wheels have been proposed having small central openings within which a curved portion of a driving rod may be inserted to serve as a "axle" for the wheel in rolling the same along the ground.

In spite of many improvements effected over the years, there can still exist certain disadvantages in presently available wheel and rod toys. For example, where the wheel is simply a metal rim and lying on its side, a child inadvertently stepping on the rim can cause the rim to swing upwardly so that the diametrically opposite portion bangs into his shins, causing considerable pain. From this standpoint, wheels of the metal rim type can be hazardous. Moreover, the driving rod employed can be dangerous in that the swinging about of the rod could result in inadvertently poking out a child's eye. Finally, and a particularly important consideration, is the fact that with presently available wheel and rod toys, if the wheel gets out of control, there is really no easy way for the user to capture or retrieve the wheel. As a consequence, should the wheel start to roll into the street, the user would follow the wheel with a rod attempting to guide it back onto the sidewalk. Again, a child is subject to being run over by a car under such circumstances.

BRIEF DESCRIPTION OF THE PRESENT INVENTION

Bearing the foregoing in mind, the present invention contemplates an improved wheel and driving rod toy wherein certain disadvantages associated with prior art devices as discussed above are overcome.

More particularly, the wheel and driving rod of this invention are so designed that it is not possible when the wheel is lying on its side and stepped upon for the same to pop up and injure the leg of a child. Moreover, both the wheel and driving rod are so designed that the rod can be used to capture the wheel should it get out of control.

Briefly, the foregoing features are realized by providing a wheel assembly comprised of a first flat disc of given outside diameter having a central opening cooperating with a second flat disc of the same given outside diameter and same central opening diameter. A filler ring of sponge-like foam is sandwiched between and secured to the inner faces of the first and second discs to provide the wheel assembly. A metal rim encircles the periphery of the filler ring midway between the discs, the dics, filler ring and metal rim all being coaxial.

With the foregoing arrangement, stepping on the edge of the disc will not result in any possibility of the wheel popping upwardly to injure a child.

The driving rod in accord with this invention has a handle and elongated stem terminating in a hook dimensioned to straddle the outer peripheral edges of the assembled wheel so that the wheel can be nudged along by the rod in rolling engagement with the ground with a fair degree of control. Moreover, should the wheel roll away in an unintended direction, the hook portion of the rod can be passed through the relatively large central openings in the components of the wheel to thereby capture the wheel. In other words, the end of the driving rod can be used to actually hook the inner opening of the wheel to lift the entire wheel from the ground and prevent it rolling into the street.

BRIEF DESCRIPTION OF THE DRAWINGS

A better understanding of the foregoing as well as further features and advantages of this invention will be had by now referring to a preferred embodiment as illustrated in the accompanying drawings in which.

DETAILED DESCRIPTION OF THE PREFERRED EMBODIMENT

Figure 1:
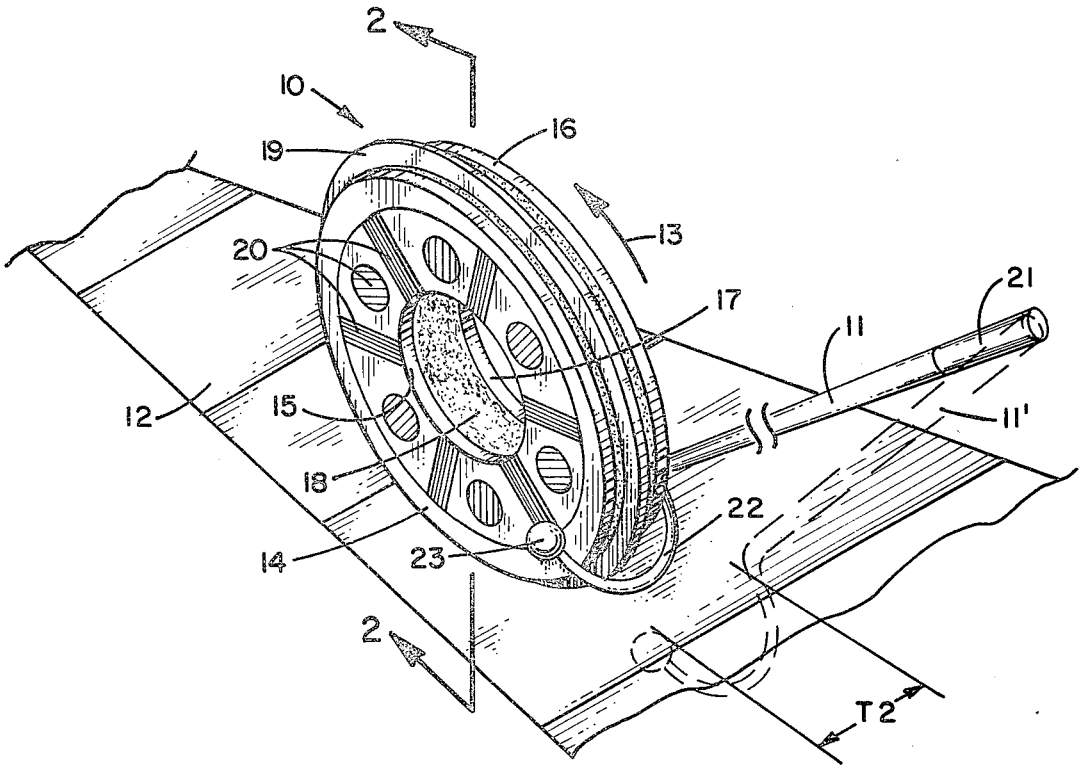
FIG. 1 is a perspective view of the wheel assembly and driving rod of this invention in operation.

Referring first to FIG. 1, the toy wheel is designated generally by the numeral 10 and is arranged to be nudged along as by a driving rod 11 in rolling engagement with the ground or pavement 12. The direction of rotation is indicated by the arrow 13.

Figure 2:
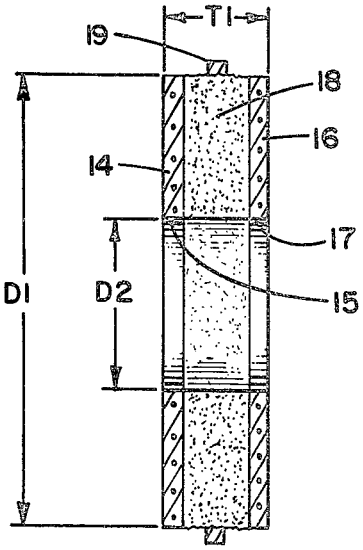
FIG. 2 is a cross section of the wheel taken in the direction of the arrows 2—2 of FIG. 1; and, FIG. 3 is a side elevational view of the wheel showing the manner in which the driving rod can be used to "capture" the wheel should it get out of control.

Referring to both FIGS. 1 and 2, the wheel 10 itself is comprised of a first flat disc 14 of given outside diameter D1 having a central opening 15 of diameter D2. The flat disc 14 may be made of wood or cardboard. The diameter D2 ranges from 0.2 to 0.8 the given outside diameter D1. In other words, the central opening in the disc is relatively large.

A second flat disc 16 is of the same given diameter D1 as the first mentioned disc and similarly has a central opening 17 of diameter corresponding to the diameter of the central opening 15; that is, D2.

Sandwiched between the first and second discs 14 and 16 is a filler ring of sponge-like foam 18. This foam is secured to the opposing faces of the discs 14 and 16. The assembly is completed by the provision of a metal rim 19 encircling the periphery of the filler ring 18 midway between the discs, the discs, filler ring and metal rim all being coaxial as evident from FIG. 2. The purpose for the metal rim is to generate noise when the wheel is rolled along a pavement. However, the positioning of the rim 19 as shown well between the outer peripheral margins of the wheel prevents any possibility of accidents should a person step on the outer peripheral portion of the wheel. That is, there is no possibility of the wheel swinging up and hitting the child.

Referring specifically to FIG. 1, at least one of the discs and preferably both is provided with a psychodelic design 20 which may be varied as desired to provide visual amusement to a child as the wheel rolls along the ground.

Still referring to FIG. 1, the driving rod 11 includes a handle portion 21 and extending stem terminating in a hook 22. The extreme end of the hook portion 22 terminates in a rubber ball 23 thereby decreasing the risk of the end of the driving rod injuring a child. As indicated by the solid line showing of FIG. 1, the hook portion 22 is dimensioned to straddle the outer peripheral edges of the assembled wheel so that the wheel can be nudged along by the rod in rolling engagement with the ground as described. In this respect, the rod is shown in a dotted line 11' disengaged from the wheel. The dimensioning of the hook portion is indicated at T2 for the dotted line showing 11'. This dimension is made greater than the axial thickness of the wheel designated T1 in FIG. 2. T1 is from 0.05 to 0.25 the given outside diameter D1.

Figure 3:
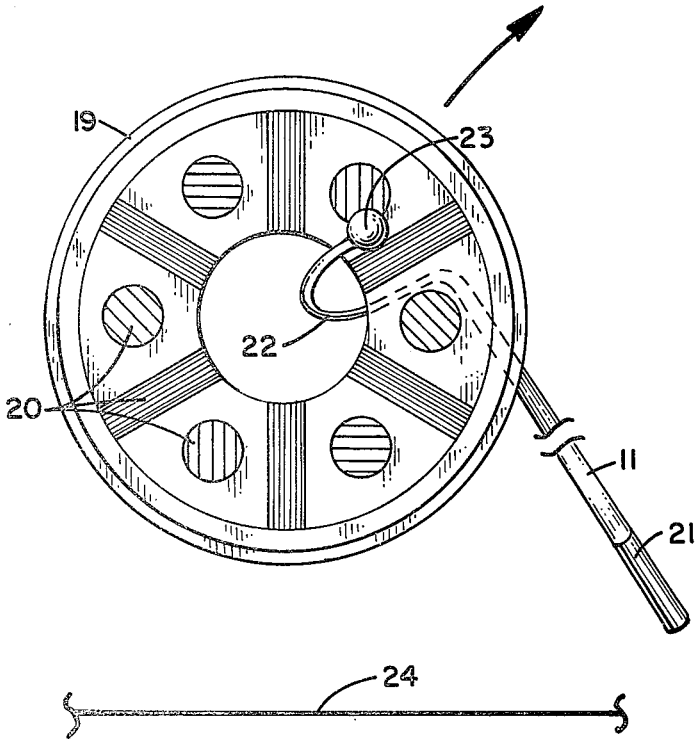

FIG. 3 illustrates the wheel in side elevation wherein the driving rod 11 has been manipulated to have its hooked portion 22 pass through the central opening of the wheel to capture the wheel and enable lifting of the same from the ground shown at 24. It can thus be appreciated that should the wheel travel in an unintended direction, the user can readily capture the same by inserting the hook portion through the central opening and simply lifting the wheel free of the ground.

From all of the foregoing, it will be evident that the present invention has provided a greatly improved wheel and rod toy having certain advantages. First, there is provided the noise generated by the metal rim which children seem to enjoy without the accompanying danger of the metal rim itself. Further, the psychedelic design on the outer faces of one or both of the discs provides visual amusement to the child. Finally, the unique hook structure of the driving rod 11 permits the child to nudge the wheel along by engaging the outer peripheral portion thereof periodically with a fair degree of control. On the other hand, should the wheel get out of control, the child can easily pass the hook portion 22 through the central opening and capture the wheel, all as described in conjunction with FIG. 3.

I claim:

1. A toy wheel and driving rod comprising, in combination:

(a) a first flat disc of given outside diameter having a central opening of diameter from 0.2 to 0.8 said given outside diameter;

(b) a second flat disc of the same given outside diameter as said first flat disc having a central opening of the same diameter as the central opening in said first flat disc;

(c) a filler ring of sponge-like foam sandwiched between and secured to the inner faces of said first and second discs to define said wheel;

(d) a metal rim encircling the periphery of said filler ring midway between said discs, the discs, filler ring and metal rim all being coaxial; and (e) a driving rod having a handle and elongated stem terminating in a hook dimensioned to straddle the outer peripheral edges of the assembled wheel so that the wheel can be nudged along by said rod in rolling engagement with the ground and whereby should the wheel roll away in an unintended direction, the hook portion of the rod can be passed through the central opening of the wheel to capture the wheel.

2. A toy wheel and driving rod according to claim 1, in which the axial thickness of said wheel is from 0.05 to 0.25 said given outside diameter.

3. A toy wheel and driving rod according to claim 2, in which the outside face of at least one of the first and second flat discs has a psychedelic design thereon.

4. A toy wheel and driving rod according to claim 3, in which the extreme end of the hook portion of said driving rod terminates in a rubber ball.

* * * * *